US008905162B2

(12) United States Patent
Torres

(10) Patent No.: US 8,905,162 B2
(45) Date of Patent: Dec. 9, 2014

(54) HIGH EFFICIENCY HYDRAULIC DRILL BIT

(75) Inventor: Carlos Torres, San Antonio, TX (US)

(73) Assignee: Trendon IP Inc., Calgary, Alberta (CA)

( * ) Notice: Subject to any disclaimer, the term of this patent is extended or adjusted under 35 U.S.C. 154(b) by 491 days.

(21) Appl. No.: 12/806,609

(22) Filed: Aug. 17, 2010

(65) Prior Publication Data

US 2012/0043087 A1 Feb. 23, 2012

(51) Int. Cl.
*E21B 10/44* (2006.01)
*E21B 10/60* (2006.01)

(52) U.S. Cl.
CPC ..... *E21B 10/602* (2013.01)
USPC ..... 175/394; 175/323

(58) Field of Classification Search
CPC ..... E21B 10/18; E21B 10/60; E21B 10/38; E21B 10/61
USPC ..... 175/394, 323
See application file for complete search history.

(56) References Cited

U.S. PATENT DOCUMENTS

| | | | | |
|---|---|---|---|---|
| 2,776,115 | A | 10/1953 | Williams | |
| 3,656,565 | A * | 4/1972 | Fox | 175/323 |
| 4,239,087 | A | 12/1980 | Castel | |
| 4,540,055 | A | 9/1985 | Drummond et al. | |
| 4,583,603 | A | 4/1986 | Dorleans et al. | |
| 4,618,010 | A | 10/1986 | Falgout et al. | |
| 4,727,943 | A * | 3/1988 | Wood | 175/229 |
| 5,363,932 | A | 11/1994 | Azar | |
| 5,547,033 | A | 8/1996 | Campos | |
| 5,651,420 | A | 7/1997 | Tibbitts et al. | |
| 5,794,725 | A | 8/1998 | Trujillo | |
| 5,836,404 | A | 11/1998 | Trujillo | |
| 5,957,223 | A | 9/1999 | Doster | |
| 6,123,160 | A | 9/2000 | Tibbitts | |
| 6,206,117 | B1 | 3/2001 | Tibbitts | |
| 6,230,827 | B1 | 5/2001 | Trujillo | |
| 6,290,007 | B2 | 9/2001 | Beuershausen | |
| 6,302,223 | B1 | 10/2001 | Sinor | |
| 6,935,442 | B2 * | 8/2005 | Boulet et al. | 175/325.3 |
| 7,931,098 | B2 * | 4/2011 | Aronstam et al. | 175/61 |
| 2002/0129976 | A1 * | 9/2002 | Rastegar | 175/325.3 |
| 2009/0260878 | A1 * | 10/2009 | Morley et al. | 175/45 |
| 2010/0147594 | A1 | 6/2010 | Lamin | |
| 2010/0300761 | A1 * | 12/2010 | Earles et al. | 175/76 |

OTHER PUBLICATIONS

PCT International Search Report for Patent Application No. PCT/IB2011/002631, dated Mar. 14, 2012 (7 pages).

* cited by examiner

*Primary Examiner* — William P Neuder
*Assistant Examiner* — Kipp Wallace

(57) ABSTRACT

A drill bit for enhancing drilling operations, where the drill bit includes a bit body configured for coupling to a drillstring, and a bit face disposed on an end of the bit body with at least one cutting structure attached thereto. There is a fluid guide operatively connected to the drill bit and disposed above the end of the bit body, where the fluid guide includes at least one nozzle disposed therein that is in fluid communication with a fluid cavity disposed in the drill bit, and where the fluid guide is configured to induce distribution of fluid flow in a flow regime above the drill bit.

13 Claims, 13 Drawing Sheets

HIGH EFFICIENCY HYDRAULIC DRILL BIT

BACKGROUND OF DISCLOSURE

1. Field of the Disclosure

Embodiments disclosed herein generally relate to drill bits used in drilling subterranean formations. Other embodiments relate to the design of drill bits, including variations in nozzle size, nozzle orientation, and fluid guide configurations, which may be optimized to provide enhanced cuttings removal from a wellbore. In still other embodiments, the present disclosure relates to apparatuses and methods to improve the efficiency of hydraulic cleaning around the drill bit during drilling operations.

2. Background Art

Conventional drilling systems typically include the presence of a drill bit connected at the bottom of a rotatable drillstring. FIGS. 1A-1D together illustrate a drilling system 101 that uses a drill bit 109 to drill a wellbore 105 in a subterranean formation 103. As shown in FIG. 1A, a rotary table 98 or other device (e.g., top drive, etc.) is used to rotate the drillstring 102, which results in a corresponding rotation of the drill bit 109 at the end of the drillstring 102. FIGS. 1B and 1C show the drill bit 109 includes a bit body 114 secured to a steel shank 123 and a pin connection 124, which are configured to connect the drill bit 109 to the drill string 102. The bit body 114, which includes a bit face 115, is fitted with cutting structures (e.g., blades) 116 that are configured to cut (i.e., dig, crush, shear, etc.) into the formation 103.

Generally, if the bit 109 is a fixed-cutter, or "drag" bit, the cutting structures 116 will have a plurality of cutting elements 118, such as cutters, inserts, PDC inserts, compacts, etc. These cutting elements 118 have cutting surfaces formed of an abrasive material, such as, for example, polycrystalline diamond compacts ("PDCs"), thermally stable polycrystalline diamond compacts ("TSPs"), natural diamonds, as well as cubic boron nitride compacts, and are oriented on the bit face 115 in the direction of bit rotation. A drag bit body is usually formed of machined steel or a matrix casting of hard particulate material such as tungsten carbide in a (usually) copper-based alloy binder. The cutting elements 118 may be secured to the blades 116 and/or the bit body 114 as would be known to one of ordinary skill in the art, such as during a furnacing operation or a brazing process.

The typical drilling system 101 also provides drilling fluid (e.g., "drilling mud," "mud," etc.) 111 that is transported down the drill string 102 and into the drill bit 109. Surface equipment 113, such as pumps, is used to create pressure and flow rate to circulate the drilling fluid 111 thru the drillstring 102. The drillstring 102 typically has an internal bore or flow passage 103*a* that extends from, and is in fluid communication between, the surface equipment 113 and the drill bit 109. The size (e.g., diameter) of the drillstring 102 with respect to the wellbore 105 defines an annulus 106 that allows for return of drilling fluid and any entrained cuttings (e.g., formation cuttings, other debris, etc.) to the surface.

Referring to FIGS. 1A-1C together, the drilling fluid 111 is pumped from, for example, a mud pit 112, into the internal bore 103*a*, and down to the drill bit 109 through a bit inlet 130 and fluid cavity or plenum 126. The drilling fluid 111 flows from the plenum 126 through one or more internal channels or bores 128, and out of the drill bit 109 via one or more nozzles 122 (and corresponding orifice) in connection therewith. The pressure of the drilling fluid 111 as delivered to the bit face 115 through the nozzles 122 (or other ports, openings, etc.) must be sufficient to overcome the hydrostatic head at the drill bit 109, and the flow velocity must be sufficient to carry the drilling fluid 111 (along with entrained cuttings) away from the bit face 115, through the annulus 106, and to the surface 107.

As drilling fluid 111 exits the drillstring 102, the fluid enters the plenum 126 of the drill bit 109. The velocity of the drilling fluid 111 that enters the plenum 126 is usually relatively low, but as the fluid enters the orifice 122*a* of the nozzles 122 the fluid velocity increases substantially as a result of the reduction of exit area in the orifice. The nozzles 122 are typically placed at or near the bit face 115 for various purposes, whereby the fluid performs several functions, such as cooling the drill bit 109, evacuating cuttings from the bit 109 to the surface 107, and providing wellbore integrity.

These functions are extremely important in order for the drill bit 109 to efficiently cut the formation 103 over a commercially viable drilling interval. Because of the weight on bit (WOB) applied by the drillstring 102 as necessary to achieve a desired rate of penetration (ROP), there is substantial frictional heat generated on the bit face 115. As a result, the drilling fluid 111 is necessary and essential to cool the drill bit 109. Without the drilling fluid 111, the drill bit 109, including the bit face 115 and the cutting elements 118, would structurally degrade and prematurely fail.

The drilling fluid 111 is also vital for the removal of cuttings and/or other debris from the bit face 115. Stationary cuttings around the bit face 115 impede the cutting efficiency of the drill bit 109 by obstructing the access of the cutting elements 118 to the formation 103. In addition, stagnant flow around and above the drill bit 109 contributes to inefficient removal of cuttings from the bit face 115 because of inadequate flow regimes around the drill bit 109. Stagnant or reduced flow of drilling fluid 111 also results in less-effective cooling of the cutting elements 118 in areas where the flow is impeded.

These conditions often lead to "bit balling," whereby without removal of the cuttings, the cutting elements 118 (and the bit face 115) ball up with material cut from the formation 103. It is recently recognized that bit balling originates or initiates at the gage area (i.e., side) 138 of the bit body 114. Once the gage area 138 is blocked and clogged, the mass of formation cuttings builds back down toward the bit face 115 and/or onto the face, until the drill bit 109 completely balls. Bit balling renders the drill bit 109 as unable to effectively engage and further penetrate into the formation 103 to advance the wellbore 105.

Modern drill bits typically include "junk slots" 165 formed on the exterior of the bit body 114 to aid flow patterns around the drill bit 109. The junk slot 165 is usually adjacent to and/or between corresponding bit blades 118, such that the junk slots 165 are configured for the drilling fluid 111 to flow from the nozzles 122 disposed in the bit face 115, past the drill bit 109, and to the annulus 106 above the drill bit 109. The intent of the junk slots 165 is to promote and pass the flow of drilling fluid 111 along each corresponding blade 118. However, the position and angular orientation of any nozzle 122 may be different, whereby the magnitude and orientation of flow energy of the drilling fluid varies from one junk slot to the next, which usually leads to inefficient and uneven distribution of hydraulic energy.

For example, a relatively higher flow pressure may generate an adjacent zone or area of relatively lower hydraulic pressure. When this occurs, drilling fluid that emanates from a particular nozzle that would ideally flow past the desired cutting elements of a particular blade and up through the associated junk slot may actually be pulled or drawn downward into a low pressure zone created by a flow regime of another junk slot. In effect, some of the junk slots 165 will have a positive or upward flow of drilling fluid, while others will have a negative or downward flow, which is detrimental to the intended desired flow pattern in the junk slots. In typical prior art drill bits this results in stagnant flow regions in and above the junk slots, usually adjacent, behind and above the blades because of the inefficient distribution of drilling fluid.

FIG. 1D illustrates an example of a stagnant flow regime 171 that leads to a build up and/or uneven distribution of cuttings 132 in certain areas of the wellbore 105. This may be especially troublesome in directional or horizontal drilling where the effects of gravity cause further separation and/or settling of cuttings (or other debris) 132. The cuttings generated during the drilling process that would normally flow up through the annulus 106 may circulate from a positive flowing junk slot to a negative flowing junk slot, or may accumulate adjacent or above a blade in regime 171, the result in either case thereby leading to bit balling of the drill bit 109.

The aforementioned phenomenon of bit balling has become a more serious problem in recent years. The design of newer bits often includes the use of superabrasive cutters in order to achieve higher ROP. However, while marked increases in ROP have been achieved, the inability of drill bits to clear formation cuttings at a rate commensurate with the bits' ability to generate such cuttings has proven to be a troublesome limitation to further increases in ROP. On modern, technically sophisticated drill bits, the number of nozzles 122 on the bit face 115 is typically one per blade. The limitations on the number of nozzles on a drill bit are due not only design and manufacturing constraints, but also due to surface equipment capabilities.

As such, prior art drill bits have failed to consider and appreciate the tendency of poor cuttings clearance from the drill bits as a result of the consequent balling of the bit, and improvements usually focus on incorporating design features at the bit face or plenum areas of the drill bit. However, these improvements seldom lead to higher drill bit efficiency.

As a result, there is a need for a drill bit designed to minimize balling, as well as a drill bit and/or other drilling-related structures that provide enhanced hydraulic characteristics and the advantages associated thereof. There is a need for a drill bit that enhances the hydraulics around the drill bit in areas other than the bit face.

There is a great need to provide enhancements to formation cuttings clearance for drill bits through design improvements that may be implementable in any drill bit. There is a need for enhanced formation cuttings clearance through optimized distribution of hydraulic energy in the form of drilling fluid. Such apportionment may be achieved by employing nozzles of differing aperture sizes and in association with fluid guides and blades configured to evenly distribute drilling fluid in, around, and above the drill bit.

There is a need to create an upwardly directed flow of fluid away from the drill bit that removes impingement of drilling fluid and cuttings against the bit face. The upwardly directed flow induces flow paths away from the bit face and optimizes fluid particle distribution, flow regime, and pressure distribution in areas above the drill bit. There is a further need to create a synergistic method of optimizing hydraulic flow by utilizing hydraulic energy at the bit face coupled with the flow traveling away from the bit. Such apportionment may be achieved by fluid guide geometry and orientation.

SUMMARY OF DISCLOSURE

Embodiments disclosed herein may provide a drill bit for enhancing drilling operations, the drill bit including a bit body configured for coupling to a drillstring and a bit face disposed on a first end of the bit body comprising at least one cutting structure. The drill bit also includes a fluid guide operatively connected to the drill bit and disposed above an end of the bit body. There is at least one nozzle disposed in the fluid guide, such that the at least one nozzle is in fluid communication with a fluid cavity disposed in the bit body. In particular, the fluid guide is configured to induce distribution of fluid flow in a flow regime above the drill bit.

Other embodiments of the disclosure may provide a fluid guide for a drill bit, whereby the fluid guide improves hydraulic cleaning of a drill bit during drilling operations. The fluid guide includes a main body having a central bore disposed therethrough, and a mating surface disposed on the main body configured to couple the fluid guide to at least one of a drill bit, a drill string, or combinations thereof. There is at least one nozzle disposed in the main body, whereby the nozzle includes an orifice that is configured to direct fluid in a direction away from the drill bit. The fluid guide further includes a first fluid guide blade disposed on an outer surface of the main body, and a second fluid guide blade disposed on the outer surface of the main body, such that the fluid guide has a flow area defined by a space between the first fluid guide blade and the second fluid guide blade. The at least one nozzle, the first fluid guide blade, the second fluid guide blade, and the flow region are designed and/or optimized to improve the hydraulic cleaning of the drill bit.

Another embodiment may provide a method of hydraulically removing debris from a wellbore that includes the steps of directionally drilling the wellbore, whereby a first part of the wellbore is further away from a surface than a second part of the wellbore located radially opposite the first part; dispersing fluid into the wellbore to fluidly move debris, wherein the fluid is dispersed in at least an upward direction from a bottom of the wellbore; evenly distributing the fluid dispersed in the upward direction, wherein the evenly distributed fluid enhances the removal of debris from the wellbore.

Other aspects and advantages of the disclosure will be apparent from the following description and the appended claims.

DETAILED DESCRIPTION

Figure 1A:
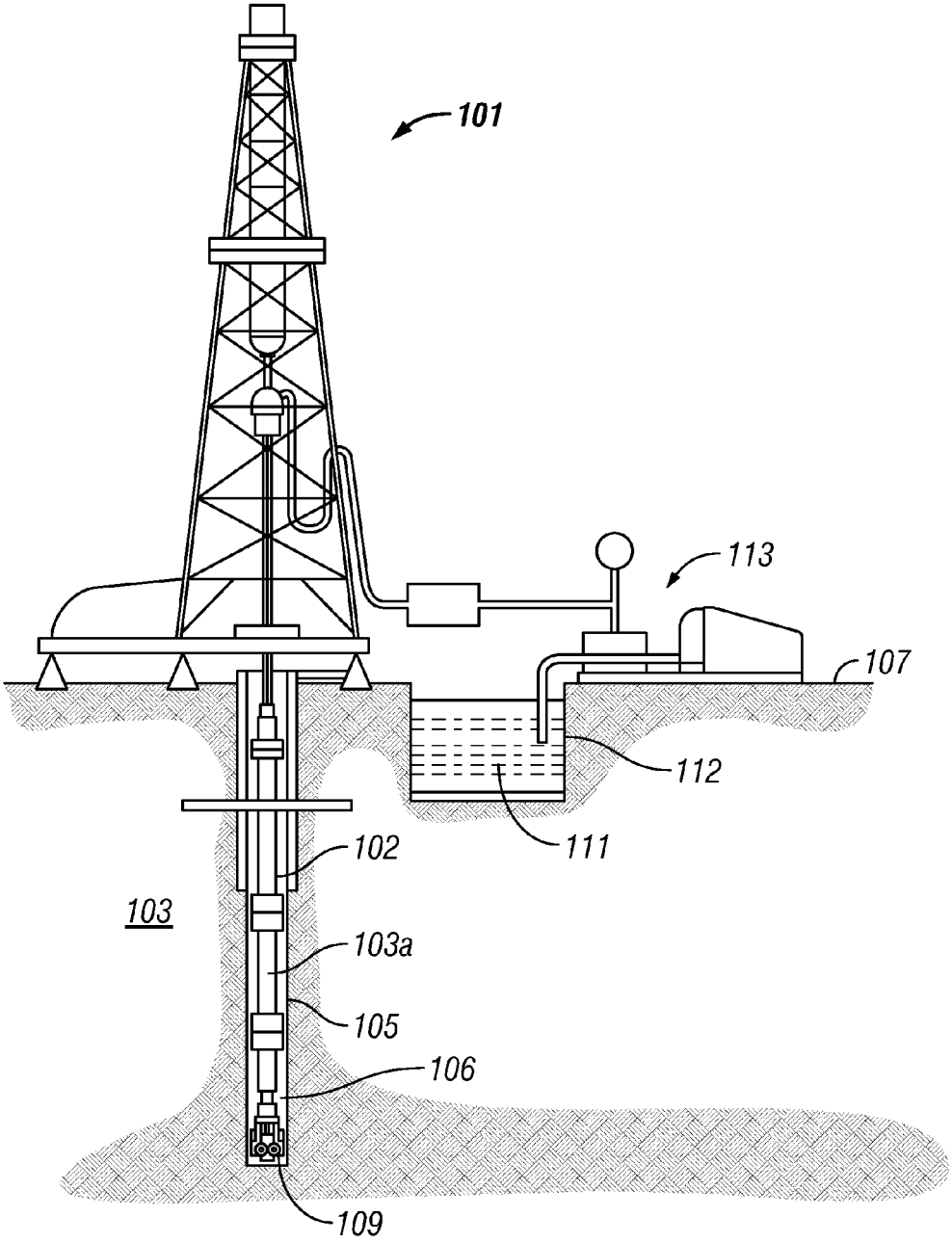
FIG. 1A (Prior Art)
FIGS. 1A, 1B, 1C, and 1D show a conventional drilling system, and a conventional drill bit used therein.
Figure 1C:
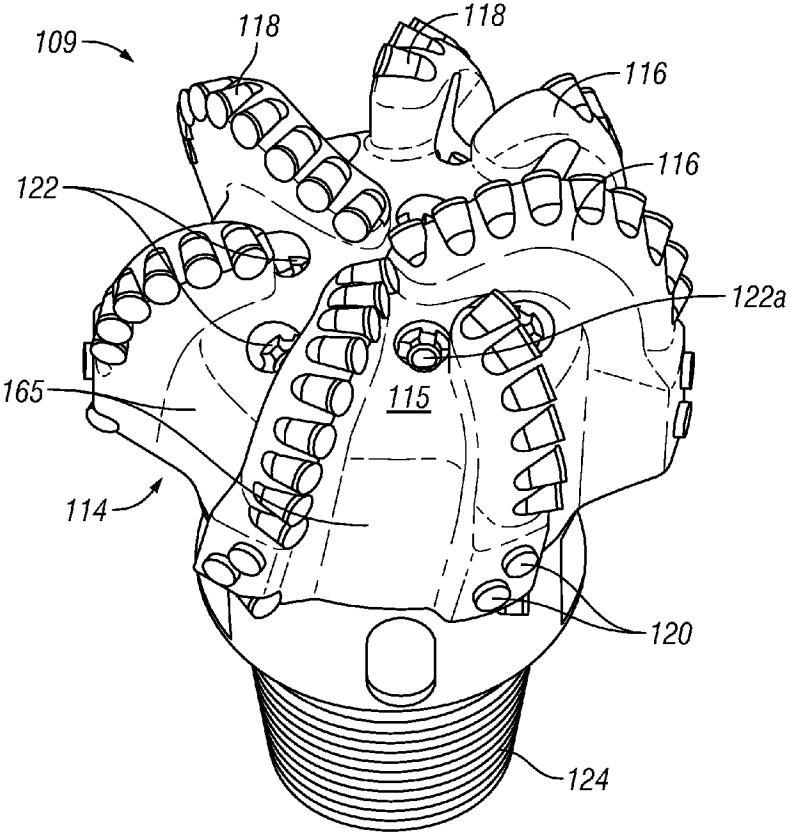
FIG. 1C (Prior Art)
Figure 1B:
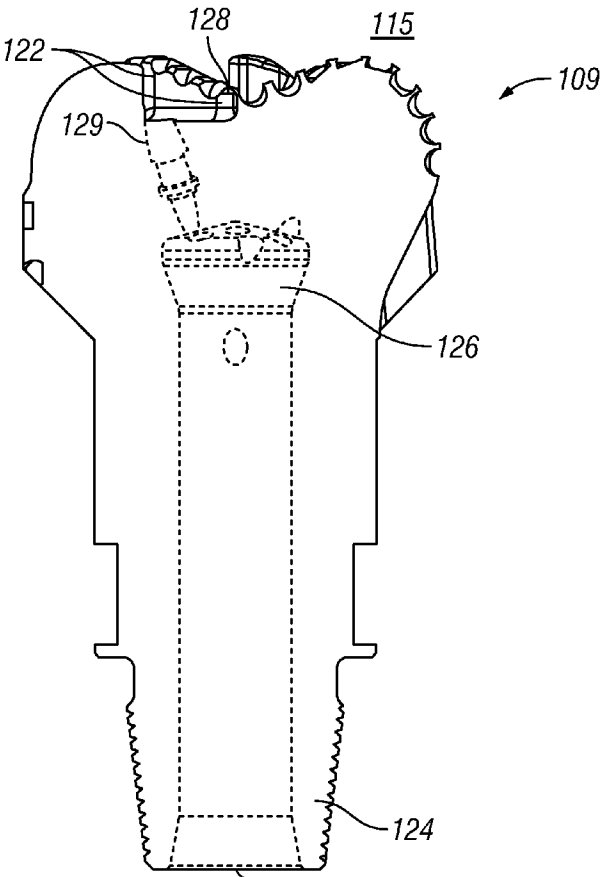
FIG. 1B (Prior Art)
Figure 1D:
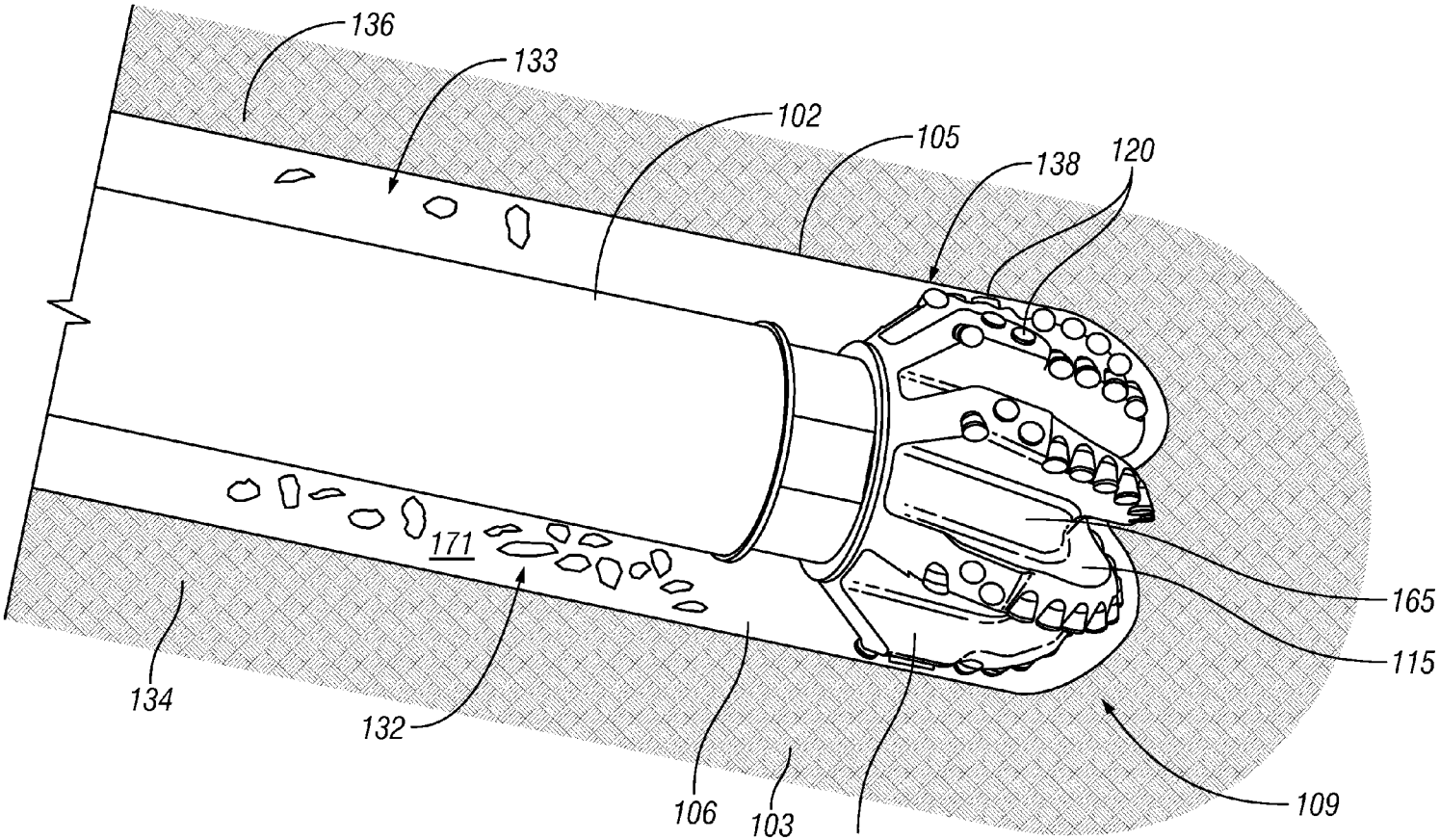
FIG. 1D (Prior Art)

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

In addition, directional terms, such as "above," "below," "upper," "lower," etc., are used for convenience in referring to the accompanying drawings. In general, "above," "upper," "upward," and similar terms refer to a direction toward the earth's surface from below the surface along a wellbore, and "below," "lower," "downward," and similar terms refer to a direction away from the surface along the wellbore (i.e., into the wellbore), but is meant for illustrative purposes only, and the terms are not meant to limit the disclosure.

Figure 2B:
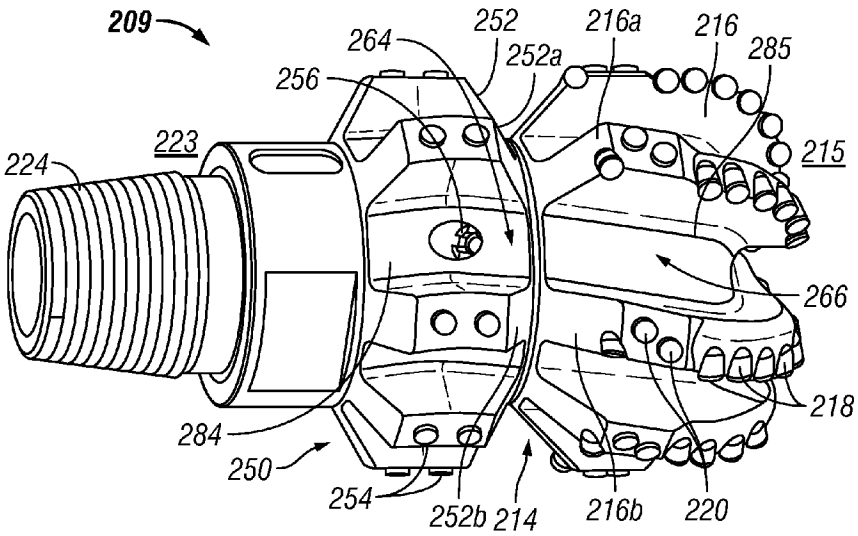
FIGS. 2A and 2B show various views of a drill bit configured with a fluid guide, in accordance with embodiments of the present disclosure.
Figure 2A:
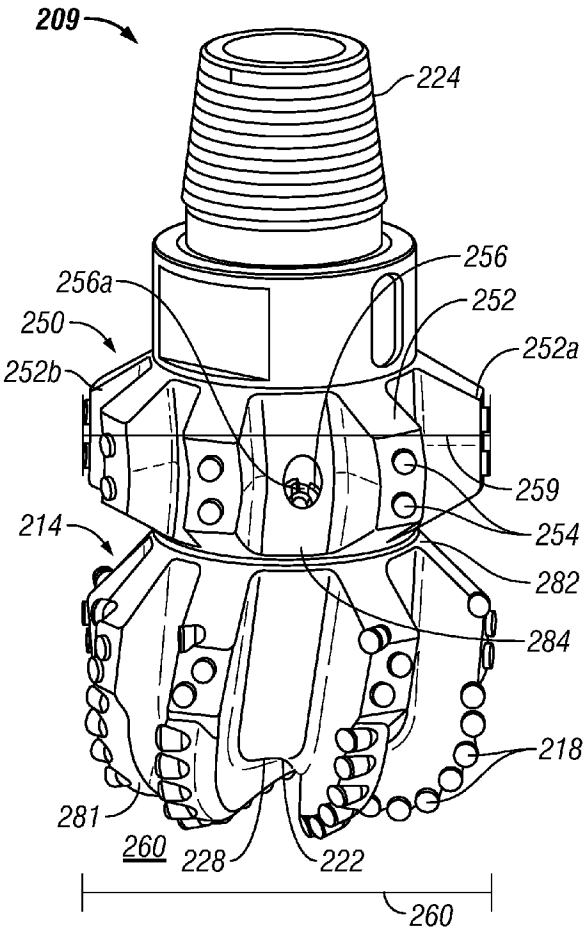

Referring now to FIGS. 2A-2D, various views of a drill bit 209 configured with a fluid guide 250 according to embodiments of the present disclosure, is shown. FIGS. 2A and 2B together illustrate an improved drill bit 209 usable to drill subterranean formations. The drill bit 209 may include a bit body 214 configured for coupling to a drillstring (302, FIG. 3B). In some embodiments, the drill bit 209 may include the bit body 214 secured to a shank 223 that may have a connection 224, whereby the shank 223 and/or connection 224 may be configured to connect the drill bit 209 to the drillstring. While the drill bit 209 may be illustrated and described as a fixed cutter drill bit, the scope of the present disclosure is not meant to be limited by any particular drill bit. As such, the drill bit 209 may be, for example, a rotary drill bit, a roller cone bit, a disc, or any other kind of drill bit known to one of ordinary skill in the art.

The bit body 214, which may include a bit face 215, may be fitted with cutting structures or blades 216 that may be configured to cut (i.e., dig, crush, shear, etc.) into the subterranean formation. One of ordinary skill in the art would recognize that the type of drill bit used would be indicative of the cutting action associated with the cutting structures or blades 216, such as rolling cones on a roller cone bit that provide crushing action or blades on a drag cutter that provide a shearing action.

As shown here, the cutting structures 216 may be cutting blades, such as those used on fixed-cutter bits. The blades, such as blade 216*a* and 216*b* may be positioned as needed in order to form junk slot 266. The junk slots 266 may allow, for example, drilling fluid, drill cuttings, and/or other debris to flow upwardly from the bit face 215 toward the second end 282 of the bit body 214.

The blades 216 may have one or more cutting elements 218 and/or gage inserts 220 disposed thereon. The cutting elements 218 may be, for example, cutters, inserts, PDC inserts, compacts, etc. These cutting elements 218 may have cutting surfaces formed of an abrasive material, such as, for example, polycrystalline diamond compacts ("PDCs"), thermally stable polycrystalline diamond compacts ("TSPs"), natural diamonds, as well as cubic boron nitride compacts, and may be oriented on the bit face 215 as necessary to provide the drilling function. The cutting elements 218 or gage inserts 220 may be secured to the blades 216 and/or the bit body 214 as would be known to one of ordinary skill in the art, such as during a furnacing operation or a brazing process.

The drill bit 209 of the present disclosure may include a fluid guide 250 usable and configured to improve the overall efficiency of the drill bit 209 during drilling operations. In a specific embodiment, the fluid guide 250 may be configured to improve the hydraulic efficiency of the drill bit 209, where hydraulic efficiency is a relationship to an amount of cuttings removed from the wellbore to the amount of cuttings created by the drill bit 209. Although FIGS. 2A and 2B illustrate the fluid guide 250 may be disposed and/or connected above a second end 282 of the bit body 214, the fluid guide 250 may be operatively connected to the drill bit 209 at any portion of the drill bit 209.

Figure 2C:
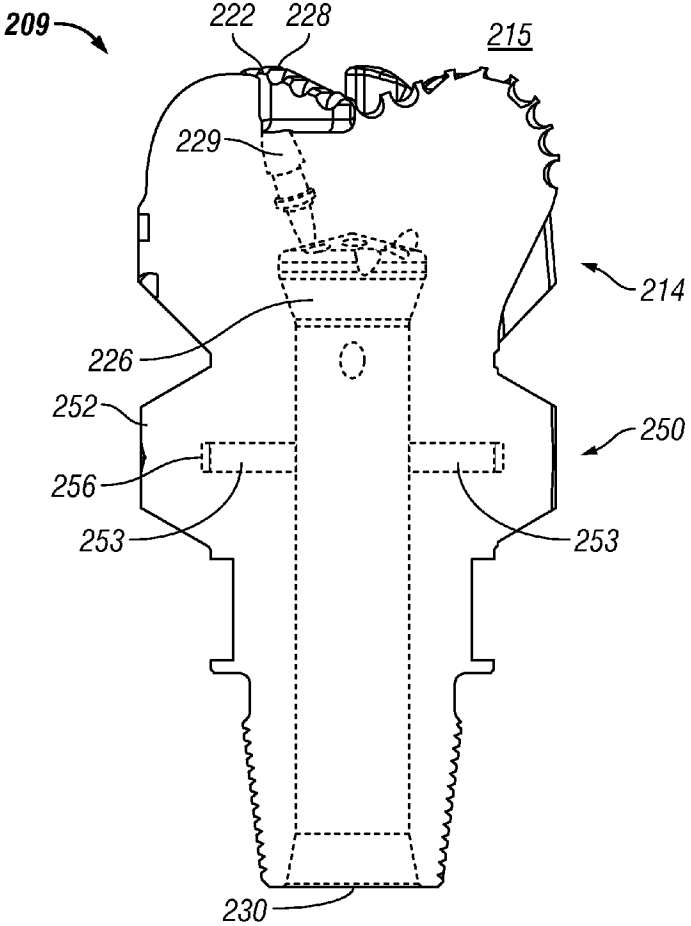
FIG. 2C shows a cross sectional view of the drill bit and fluid guide shown in FIGS. 2A and 2B, in accordance with embodiments of the present disclosure.

The bit face 215 may be disposed on a first end 281 of the bit body 214, and the bit face 215 may have at least one cutter 218 disposed thereon. FIG. 2C shows the bit face 215 (or bit body 214) may be configured with one or more nozzles 222 disposed in respective bores 228. The nozzles 222 may have internal fluid passages 229 in fluid communication with a fluid cavity or plenum 226. In addition, the fluid guide 250 may include at least one nozzle (i.e., fluid guide nozzle) 256 with an orifice (256*a*, FIG. 2A) disposed therein, as well as at least one fluid guide blade 252 disposed thereon. The at least one nozzle 256 may be in fluid communication with the plenum disposed in the drill bit 209, such as through flow passages 253. The fluid guide 250 may be configured to induce distribution of fluid flow in flow areas around and/or above the drill bit 209. In one embodiment, the fluid guide 250 may be configured to induce substantially even distribution of fluid flow above the drill bit 209. In another embodiment, the fluid guide 250 may be configured to induce uneven distribution of fluid flow above the drill bit 209.

Figure 2D:
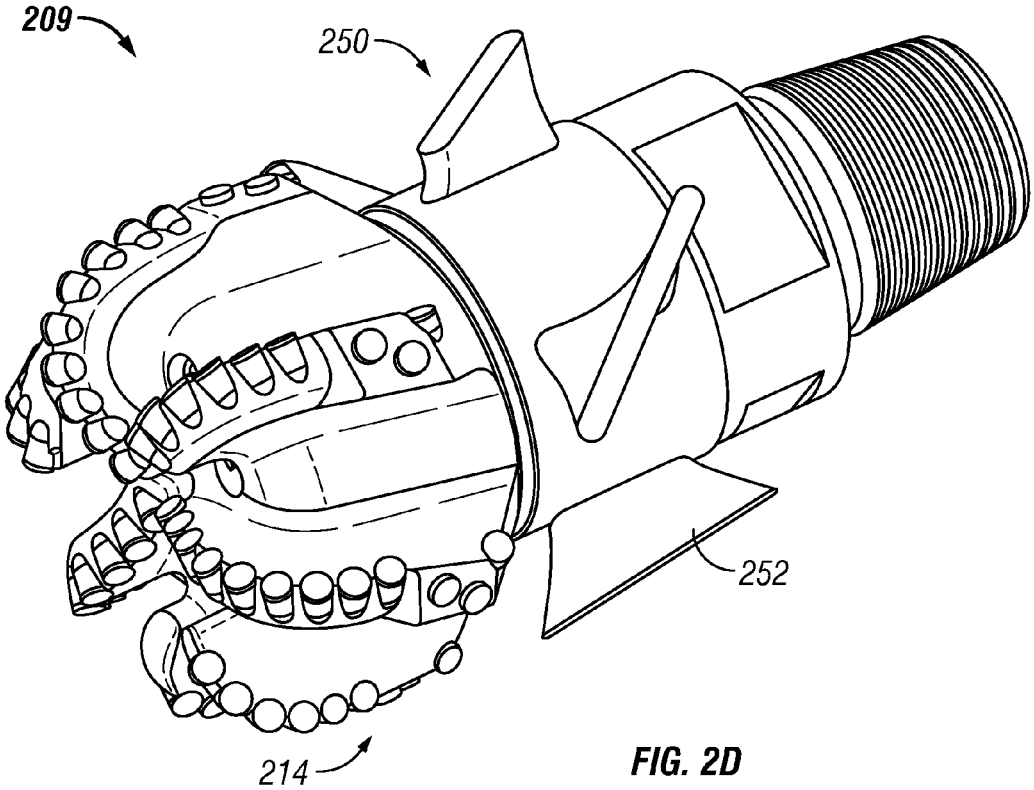
FIG. 2D shows a view of a drill bit configured with a propeller-type fluid guide, in accordance with embodiments of the present disclosure.

In an exemplary embodiment, the fluid guide 250 may be configured to propel fluids above the drill bit 209 by providing extra energy into the drilling fluid 211. In some aspects, the fluid guide 250 is configured to rotate with the drill bit 209, while in other aspects, the fluid guide 250 is configured to rotate independently from the drill bit 209. FIG. 2D illustrates the fluid guide 250 having a propeller configuration.

While not shown, the fluid guide 250 may be operatively connected with a mini motor, such as a hydraulic motor, disposed in the drill string 202. Cables, wiring, remote control, wireless, etc., or any other operative connection well known in the art may be used to convey power or force from the motor to the fluid guide 250. The connection may become operative, for example, once the drill bit 209 is connected with the drill string 202. Such a configuration is not limited to any one particular embodiment disclosed herein. One of the advantages of having a fluid guide 250 independent from the rotation of the bit 209 is the difference in speed. The ability of the fluid guide 250 to operate with a speed difference (RPM)

from that of the drill bit 209 may generate an overall higher hydraulic efficiency of the drill bit 209.

In operation, drilling fluid may flow into the drill bit at inlet 230, to the plenum 226, and out any of the nozzles 256. Because the nozzles 256 are not located on the bit face 215, the fluid exiting therefrom has no direct effect on the drilling function of the drill bit 209. Instead, the fluid guide 250 may provide extra hydraulic energy into flow areas above the bit body 214. In certain embodiments, the fluid flow from the nozzles 256 may be directed upward from the bit body 214, such that the momentum of that fluid flow induces upward flow of drilling fluid and cuttings away from the bit face 215 and bit body 214, much like a pseudo-eductor. Additional explanation of the operation of the fluid guide in accordance with embodiments disclosed herein will be provided in more detail below.

Referring again to FIGS. 2A and 2B, there may be a plurality of fluid guide blades 252 disposed along an outer surface 284 of the fluid guide 250. Likewise, there may be a plurality of cutting blades, or primary blades, 216 disposed along an outer surface 285 of the bit body 215. Any of the fluid guide blades 252 may be positioned equidistantly from other fluid guide blades 252. In an embodiment, each of the plurality of fluid guide blades 252 may be symmetrically shaped, and may be equidistantly disposed apart from each other. For example, six fluid guide blades may be disposed at approximately 60 degrees apart from each other around the surface 284. Similarly, any of the blades 216 may be positioned equidistantly from other blades 216, while other blades 216 are not. In another embodiment, each of the plurality of blades 216 may be disposed equidistantly apart from each other.

Although the fluid guide blades 252 and may appear aligned with the blades 216, embodiments disclosed herein may provide for the plurality of fluid guide blades 252 to be discontinuous from the plurality of primary blades 216. In some embodiments, the fluid guide 250 may be integral with the drill bit 209, or structurally connected by any means known in the art, such as welding, threadably, etc. In other embodiments the fluid guide 250 may be independently connected with the drill bit 209. As such, the fluid guide 250 may rotate independently from the bit body 214 and/or other portions of the drill bit 209. As such, the fluid guide 250 may be rotatably independent from rotation of at least one of the drill string (not shown), the bit body 214, and combinations thereof. Rotation of the fluid guide 250 around the bit body 215 and/or drill bit 209 may be provided, for example, by bearings, rollers, and/or other surfaces (not shown) that provide rotational capability between two bodies, as would be known to one of ordinary skill in the art.

Referring still to FIGS. 2A and 2B together, the fluid guide 250 may have an outer diameter 259 defined by, for example, the distance between the outer edge of a first fluid guide blade 252*a* to the outer edge of a second fluid guide blade 252*b* disposed 180 degrees opposite from blade 252*a* Likewise, the bit body 214 may also have a second outer diameter 260 comparably defined. In one embodiment, the fluid guide outer diameter 259 may be less than the second outer diameter 260. As such, the fluid guide 250 may be designed to provide enhanced fluid flow, instead of any drilling or stabilizing functions. However, the fluid guide 250 may be fitted with cutters or other inserts, such as gage inserts 254. The gage inserts 254 may provide a protective function in the event the fluid guide 250 could come into contact with other structures, such as the wellbore (not shown).

Figure 3B:
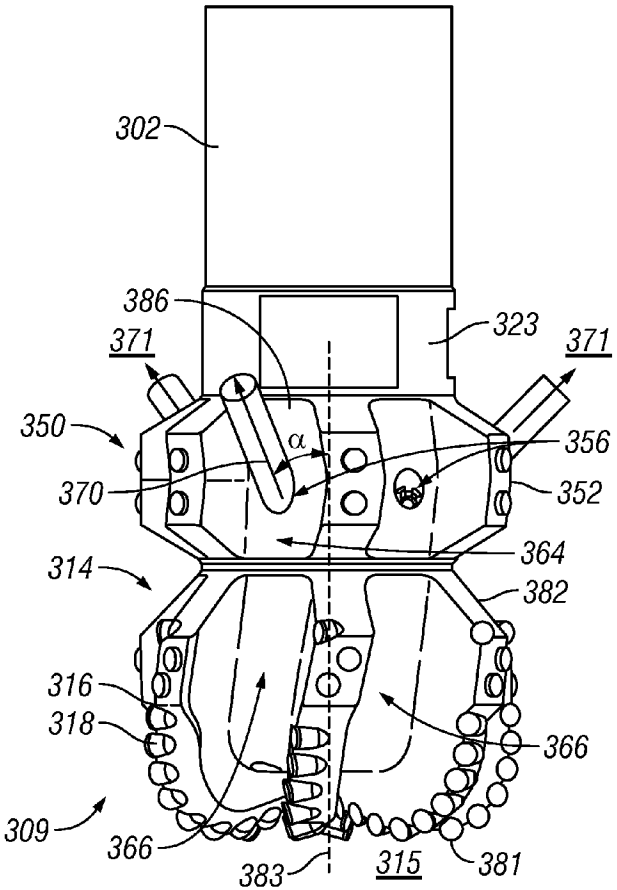
FIG. 3B shows a side perspective view of the drill bit shown in FIG. 3A.
Figure 3A:
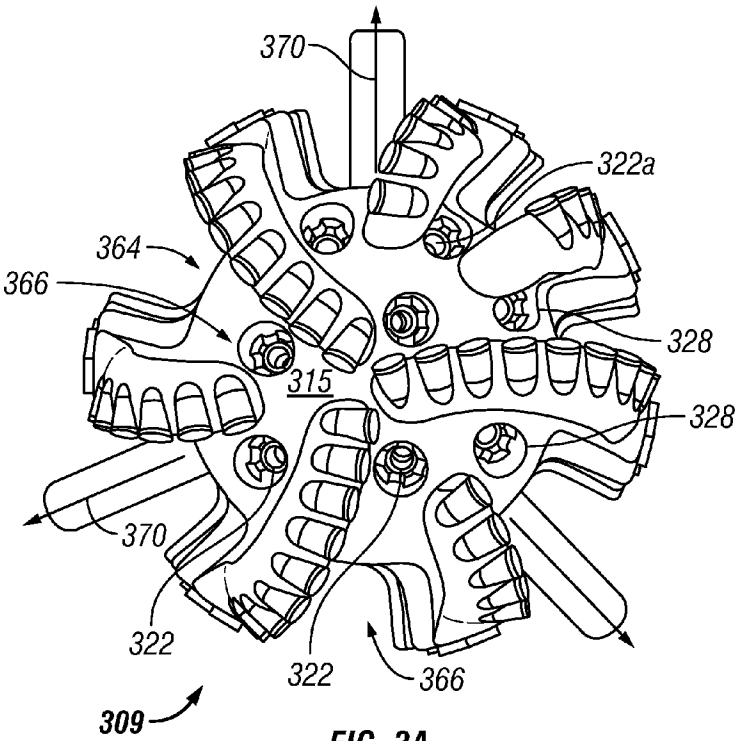
FIG. 3A shows a frontal view of a highly efficient drill bit, in accordance with embodiments of the present disclosure.
Figure 3C:
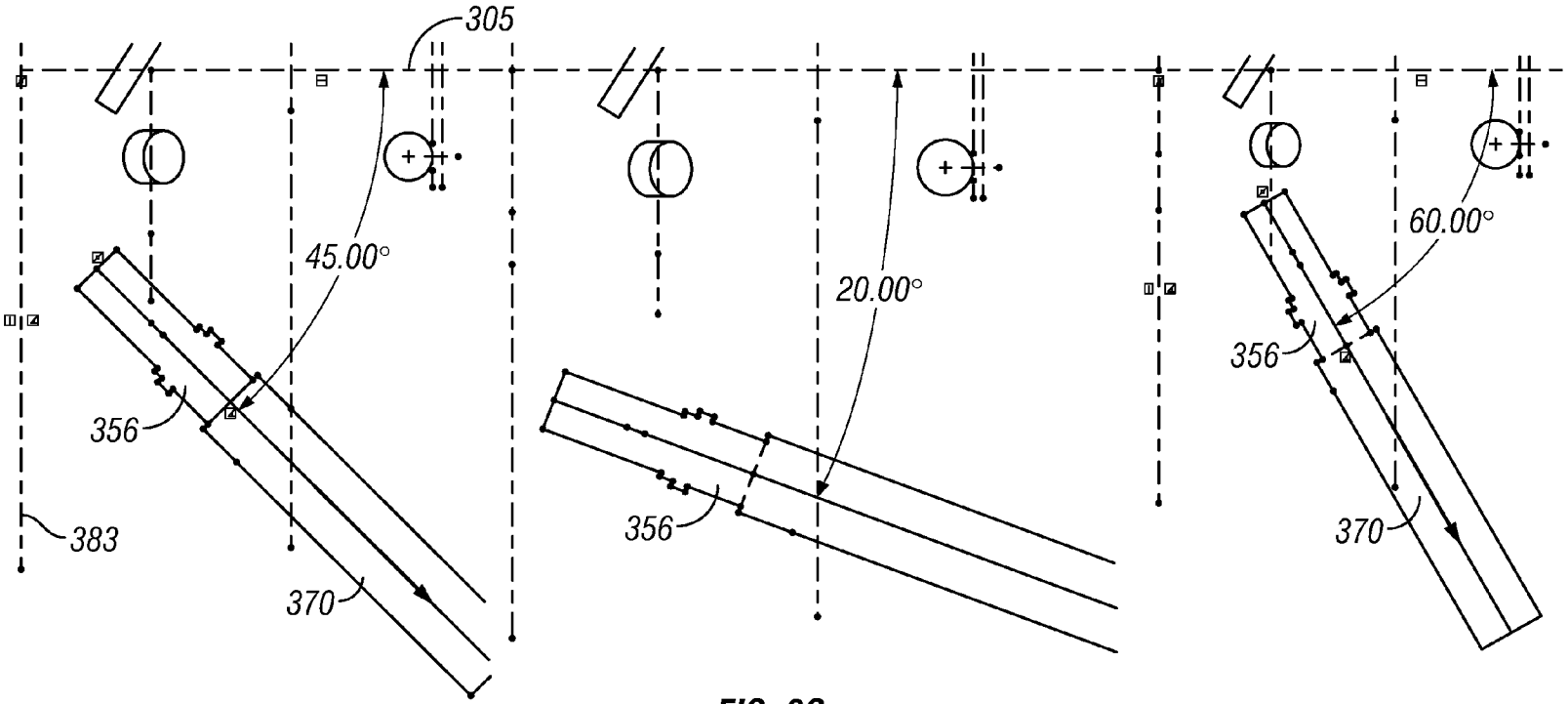
FIG. 3C shows sectional views of various orientations of nozzles used in the drill bit of FIGS. 3A and 3B, in accordance with embodiments of the present disclosure.

Referring now to FIGS. 3A-3C, various views of a drill bit 309 configured to provide improved fluid flow around the drill bit according to embodiments of the present disclosure, is shown. Like the drill bit 209 previously described, a drill bit 309 may be usable for drilling subterranean formations. As such, the drill bit 309 may include a bit body 314 configured for coupling to a drillstring 302. In some embodiments, the drill bit 309 may include the bit body 314 or other portion of drill bit 309 secured to a shank 323, which may have a threaded pin (not shown) for threadably connecting the drill bit 309 with a threaded box (not shown) of the drillstring 302.

The drill bit 309 and/or bit body 314 may include an axis 383 associated therewith. The bit body 314, which may include a bit face 315, may be fitted with cutting structures 316 that may be configured to cut (i.e., dig, crush, shear, etc.) into the subterranean formation. One of ordinary skill in the art would recognize that the type of drill bit used would be indicative of the cutting action associated with the cutting structures 316, such as rolling, crushing, shearing, etc.

As shown here, the cutting structures 316 may be cutting blades that may have one or more cutting elements 318 disposed thereon. The bit face 315 may be disposed on a first end 381 of the bit body 314, and the bit face 315 may have at least one cutting blade 316 disposed thereon. There may be a fluid guide 350 operatively connected to the drill bit 309, which may be designed, optimized, and/or configured to improve the overall efficiency of the drill bit 309. The fluid guide 350 may be comparable to the previously described fluid guide 250, such that the fluid guide 350 may be usable to improve the hydraulic efficiency of the drill bit 309. Although the fluid guide 350 may be connected to any portion of the drill bit 309, FIG. 3B illustrates the fluid guide 350 may be disposed above a second end 382 of the bit body 314.

The fluid guide 350 may include at least one nozzle (i.e., fluid guide nozzle) 356 disposed therein. The at least one nozzle 356 may be in fluid communication with a fluid cavity or plenum (226, FIG. 2C) disposed in the drill bit 309. The fluid guide 350 may be configured to induce distribution of fluid flow into a flow regime 371 above the drill bit 309, such that the fluid guide 350 may improve hydraulic efficiency of the drill bit 309 during drilling operations. It is noted that the number of nozzles in the drill bit 309 is not meant to be limited. For example, the number of nozzles 356 disposed in the fluid guide 350 may be in the range of about 0 to 20.

The fluid guide 350, as well as the nozzles 356, may be configured to induce distribution of fluid flow in flow areas 364 and 366 around the drill bit 309, as well as in flow regimes 371 above the drill bit 309. In one embodiment, the fluid guide 350 may be configured to induce substantially even distribution of fluid flow above the drill bit 309. Alternatively, the fluid guide 350 may be configured to induce uneven distribution of fluid flow above the drill bit 309. For example, during horizontal drilling, the fluid guide 350 may rotate freely from the drill bit, such that fluid from nozzles 356 is preferentially distributed into specific areas above the drill bit. As a result, there may be more "volume" of drilling fluid on the low side of the wellbore so that stagnant zones or built up solids on the low side are impacted by fluid flow. As such, the fluid guide 350 may progressively distribute fluid from the bit 309 more efficiently.

Each fluid guide nozzle 356 may have a corresponding orifice (256*a*, FIG. 2A) that has a diameter, d. In some embodiments, at least one nozzle 356 and/or orifice may be oriented at an angle, δ, from the axis 383. In other embodiments, the angle δ may be in the range of about 15 to 75 degrees. FIG. 3C illustrates varying nozzle angles of approximately 20 degrees, 45 degrees, and 60 degrees, respectively. The degrees may be referenced, for example, from the axis 383, axis 305, or any other relevant axis. Although not shown here, the angles of orientation are not limited to any one particular axis, and as such any of the nozzles 356 may have orientation angles associated with an X, Y, Z axis, as would be known to one of ordinary skill in the art. In addition, any of the nozzles 356 disposed on the fluid guide 350 may be at varied angles from other nozzles 356. For example, a first nozzle may be oriented at 20 degrees from axis 383, while a second nozzle may be oriented at 45 degrees from axis 383.

The angle of any of the nozzle 356 orientations may depend on various factors, such as the flow regime proximate to the nozzle, physical properties of the drilling fluid, drillstring or wellbore orientation, and combinations thereof. The physical properties of the drilling fluid may include, for example, weight, flow rate, temperature, pressure, velocity, and type.

Any of the orifices (256*a*, FIG. 2A) and/or respective nozzles 356 may be configured to direct fluid from the nozzle 356 in a trajectory away from the bit body 314. In one embodiment, there may be at least one nozzle 356 configured to direct fluid in a trajectory away from the bit body, as shown by the highlighted flow stream 370 (and accompanying directional arrows). In one embodiment, the fluid guide 350 may include a plurality of nozzles 356 disposed therein, whereby at least one of the plurality of nozzles 356 may direct fluid in an upward trajectory away from the second end 382 of the bit body 314.

The fluid guide 350 may have other subcomponents associated therewith, each of which may be optimized depending on various factors of any particular drilling operations, such as depth, type of formation, volume of cuttings, etc. The fluid guide 350 and/or any of the fluid guide subcomponents may be made from durable materials known to withstand extreme environments, such as the environments associated with drilling operations as known to those of ordinary skill in the art. For example, the materials of construction may be steel, carbide, tungsten carbide (hard facing), matrix, etc.

As shown, the fluid guide 350 may have a main body 386, which may include a central bore (not shown) disposed therethrough. The central bore may allow the fluid guide 350 to be disposed on or around portions of the drill bit 309 and/or bit body 314. Accordingly, the fluid guide 350 may have a mating surface (not shown) disposed on the main body 386 configured to couple the fluid guide 350 to at least one of the drill bit 309, the drill string 302, the bit body 314, or combinations thereof. In one embodiment, the mating surface may be disposed on inner surfaces that form the central bore of the fluid guide 350.

In other embodiments, the fluid guide 350 may rotate independently from the bit body 314 and/or other portions of the drill bit 309. Independent rotation of the fluid guide 350 around the bit body 315 and/or drill bit 309 may be provided, for example, by bearings, rollers, and/or other surfaces that provide rotational capability between two connected bodies, as would be known to one of ordinary skill in the art. It is noted that such a connection could just as well lead to the fluid guide 350 having a stationary position with respect to rotation of the drill bit 309.

Referring now to FIGS. 5A-5H, multiple views a fluid guide 550 configured with various blade 552 geometries to improve drill bit efficiency according to embodiments of the present disclosure, are shown. Like the fluid guides 250 and 350 previously described, fluid guide 550 may be operatively connected to drill bits used for drilling subterranean formations. FIGS. 5A-5H represent different embodiments of various fluid guides 550 that may provide different flow patterns for drill bits, where the choice and configuration of the fluid guide 550 used with a drill bit is based on, for example, type of drill bit, type of drilling (e.g., directional, steered, etc.), formation hardness, depth, amount of cuttings generated, drilling fluid physical properties, and more.

These various blade geometries are not limited to improving flow regimes around the drill bit. Some blade geometries may also enhance the flow regimes in stagnant zones in the wellbore, while others create agitation to improve overall drill bit efficiency. Some designs, such as a fluid guide 550 that uses, for example, pitch or twist angles, will create cutting lift as the fluid guide rotates. As such, some geometries may have more impact in lifting certain solids in the drilling fluid as compared to others.

Together, FIGS. 5A-5H illustrate any fluid guide 550 may have at least one nozzle 556 disposed in a bore 558 of a main body 586, where the at least one nozzle 556 may include a fluid outlet or orifice (256*a*, FIG. 2*a*). The nozzle 556 and/or orifice may be configured to direct fluid in a direction away from a drill bit, such as the previously described directional flow streams (370, FIG. 3B).

There may be at least a first fluid guide blade 552 disposed on an outer surface 584 of the main body 586, as well as a second fluid guide blade (552*a*, FIG. 5F) disposed on the outer surface 584 of the main body 586. There may be at least one or more flow areas associated with the fluid guide 550, including a flow area 564 defined by a space between the first fluid guide blade 552 and the second fluid guide blade. In some embodiments, the fluid guide 550 may be configured to induce even distribution of fluid flow in a flow area, such as, for example, an annulus (406, FIG. 4) or flow regime (371, FIG. 3B) above the drill bit (409, FIG. 4). Accordingly, the drill bit (409, FIG. 4) of the present disclosure may be designed and/or optimized to improve the hydraulic efficiency of the drill bit by varying, for example, the nozzle(s) 556, the angle $\alpha$ of the nozzle orientation, the size of the orifice (256*a*, FIG. 2A) (i.e., diameter), any of the fluid guide blades 552, and the size/shape of flow area 564.

Figure 5B:
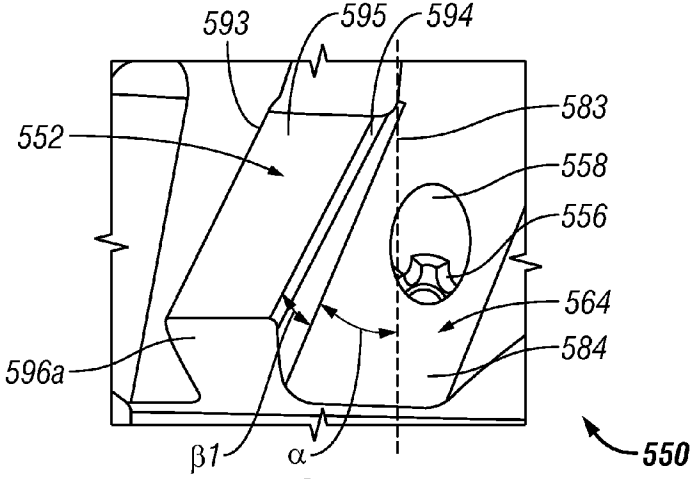
FIG. 5A-5H show multiple views a fluid guide configured with various blade geometries, in accordance with embodiments of the present disclosure.
Figure 5D:
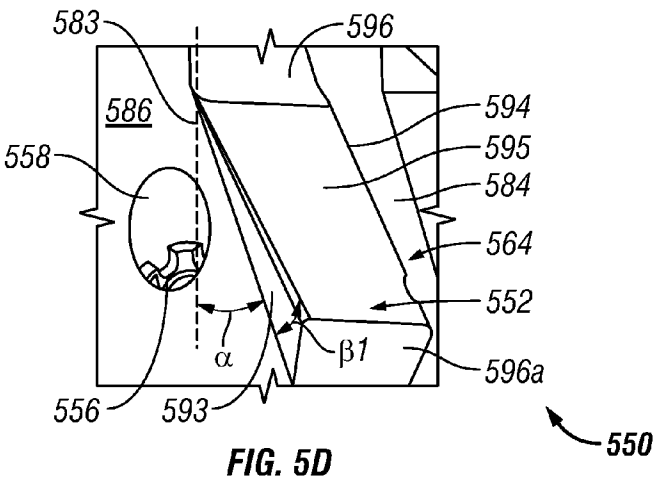

Any of the fluid guide blades 552 may be defined by a leading edge 593, a trailing edge 594, and a gage surface 595 disposed therebetween. Any of the leading edge 593, the trailing edge 594, and/or the gage surface 595 may be associated with a substantially planar surface; however, any of the edges and/or surfaces may also include an arcuate surface (or other non-planar shape) associated therewith. For example, FIG. 5C shows a substantially planar surface associated with leading edge 593 that extends from the leading edge to the outer surface 584, whereas the trailing edge 594 has an arcuate surface associated therewith. The gage surface 595 may also include at least one gage insert 554 disposed therein. In some embodiments, the geometry of any of the guide blades 552 may be further defined by a second leading edge 593*a*, a second trailing edge 594*a*, and a second gage surface 595*a*, as illustrated by FIG. 5A.

Figure 5A:
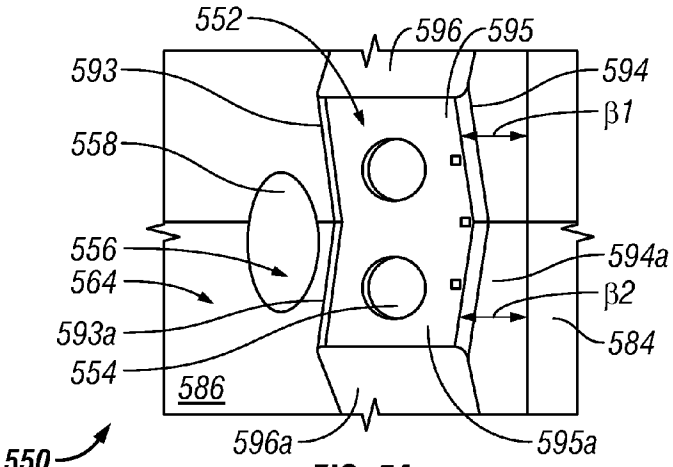
Figure 5C:
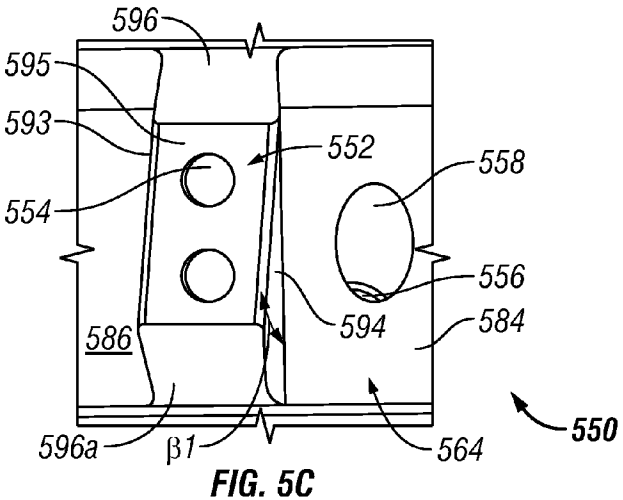
Figure 5F:
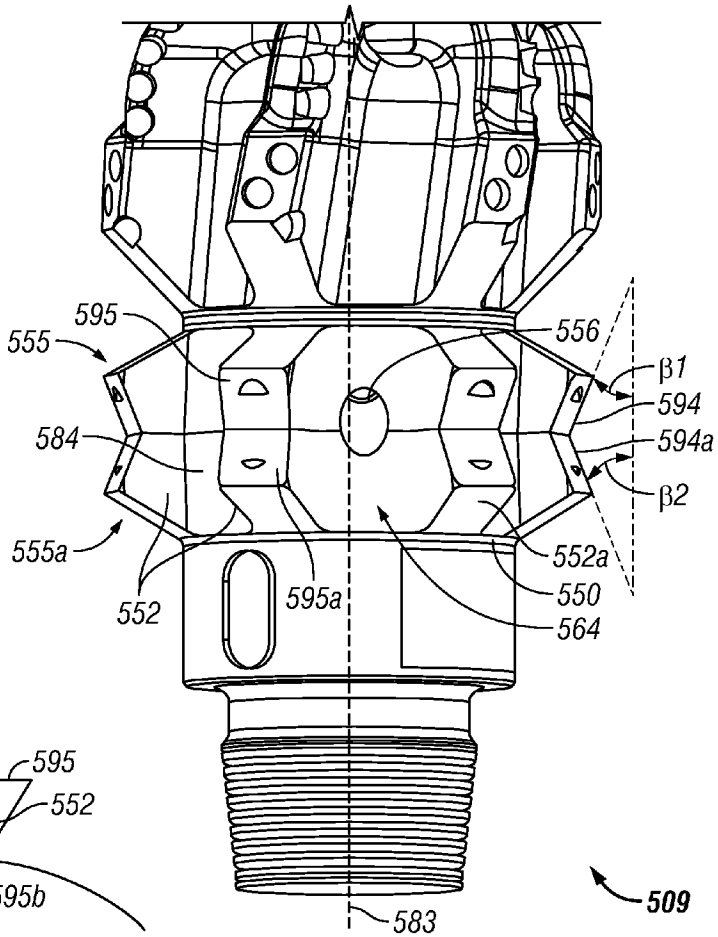
Figure 5E:
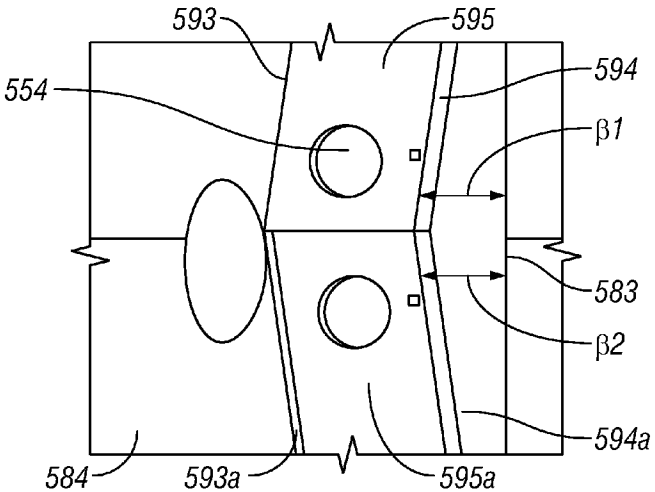

FIG. 5A illustrates the guide blade 552 may have other features associated with the geometry of the blade, such as an upper surface 596 and a lower surface 596*a*. The surfaces 596 and 596*a* may be oriented at any angle with respect to the outer surface 584. Similarly, gage surfaces 595 and 595*a* may be orientated at angles $\beta$1 and $\beta$2, respectively. The angles $\beta$1 and $\beta$2 may be, for example, in the range of 1 to 15 degrees. In addition, the angles $\beta$1 and $\beta$2 may be positive or negative. For embodiments disclosed herein, this means that a negative angle orientation would result in a crest-shaped gage surface, such as illustrated by FIG. 5E, whereas FIG. 5A illustrates an "angled in" surface as a result of a positive angle orientation.

In some embodiments, the gage surface may have only an angle $\beta$1, such as the gage surface 595 shown by FIG. 5B. As such, the entire gage surface 595 of blade 552 may have a generally inclined-surface shape as a result of a single angle β1. FIG. 5B further illustrates at least a portion of the blade 552 may be offset from an axis 583 by an angle α. Like the angles β, the angles α of any blades 552 may be positive or negative. Thus, while FIG. 5B illustrates a negative angle α of blade 552, FIG. 5D illustrates a positive angle α of blade 552, with respect to the axis 583.

Figure 5H:
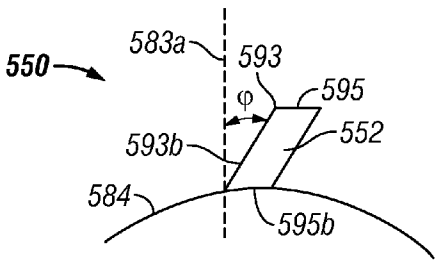
Figure 5G:
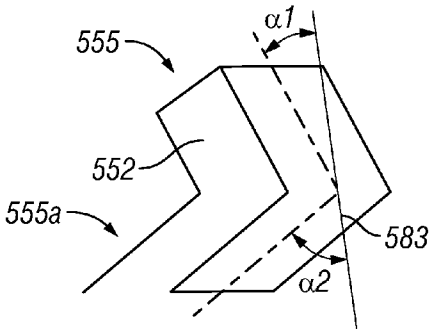

In another embodiment, the blade 552 may have angles α1 and α2 associated with a first segment 555 of the blade 552 and a second segment 555*a* of the blade 552, respectively. FIG. 5G shows, for example, that the first segment 555 and the second segment 555*a* may be generally symmetrical and/or a mirrored reflection of each other; however, the segments 555 and 555*a* are not meant to be limited, and each may vary in shape and/or form. For example, the first segment 555 may have a reduced thickness from that of the second segment 555*a*. Moreover, α1 may be smaller or larger than α2, and the angles may be positive, negative, or combinations of both.

Although embodiments disclosed herein may have blades with linear geometries, the shape of the blade 552 is not meant to be limited. As such, the blade may be unsymmetrical, have differing thicknesses, with non-linear portions, such as an "S-shaped" blade (not shown). In addition, the gage surface 595 may be at an offset angle as compared to a corresponding bottom surface 595*b* of the blade that connects with the outer surface 584. As illustrated by FIG. 5H, a downward cross-sectional view of fluid guide 550 shows the substantially planar surface 593*b* of leading edge 593 may be configured at angle ϕ from an axis 583*a*.

The fluid guide blades 552, and the geometry associated therewith, are not limited to any one particular configuration. As such, the fluid guide 550 may have at least one fluid guide blade 552 configured like the blade shown in FIG. 5A, and least one other blade 552 configured like the blade shown in FIG. 5B. Moreover, any fluid guide blade 552 may have one or more of the geometries and/or surfaces of one or more of the FIGS. 5A-5H, such that the blades 552 are not limited to any one particular configuration. For example, although not shown here, a blade 552 may have a first segment with angle α1 and β1, and a second segment with an angle α2 and β2, where the first segment has a non-planar leading edge surface and a planar trailing edge surface, and where the second segment has a planar leading edge surface and a non-planar trailing edge surface. Moreover, the thickness of the blade may vary along the entire length and width of each of the first segment and the second segment. Many more combinations of blade geometries are possible, without limitation to any the embodiments disclosed herein.

As a result of the variable geometry of the blade 552, the shape and size of flow areas 564 are also variable. As such, any number of designed and/or optimized flow patterns through and/or above flow areas 564 may be obtained via the fluid guide 550. The flow patterns may also be designed and/or optimized as a result of variation in the orientation, location, number, and size of the nozzles 556 in the fluid guide 550. The flow patterns directly relate to the hydraulic efficiency of the drill bit, where the hydraulic efficiency is related to the amount of cuttings that exit from the wellbore compared to the amount of cuttings materials generated by the drill bit. Empirical data and modeling may be used to indicate the optimal design of, for example, the blades 552.

Figure 6B:
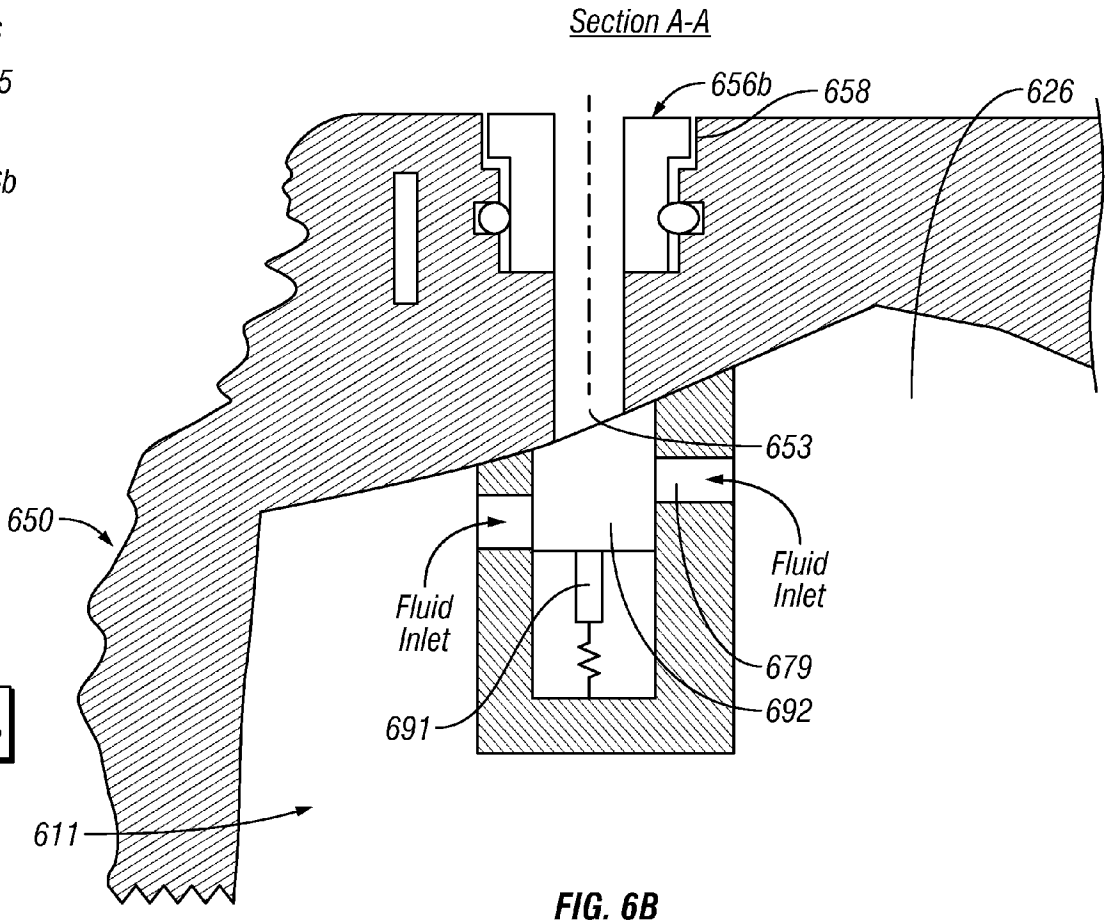
FIG. 6B shows a cross-sectional view of the electronically controlled fluid guide of FIG. 6A, in accordance with embodiments of the present disclosure.
Figure 6A:
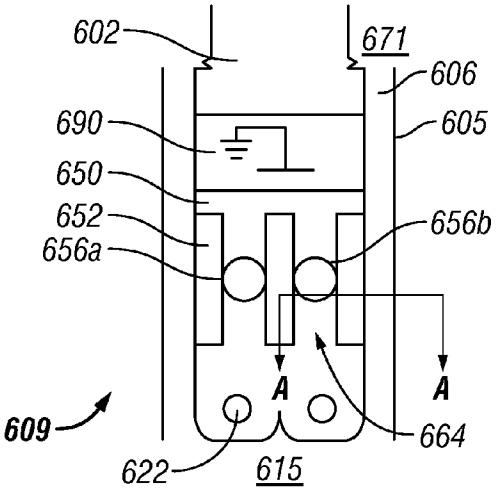
FIG. 6A shows a side perspective view of an electronically controlled fluid guide, in accordance with embodiments of the present disclosure.
Figure 6C:
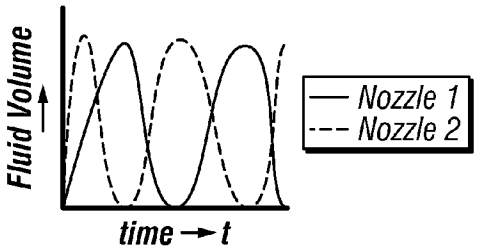
FIG. 6C shows a graphical illustration of electronic oscillatory control of the fluid guide of FIG. 6A, in accordance with embodiments of the present disclosure.

Referring now to FIGS. 6A-6C, an electronically controlled fluid guide 650 in accordance with embodiments disclosed herein, is shown. Like the fluid guides previously described, fluid guide 650 may be operatively connected to a drill bit 609 used for drilling subterranean formations. The fluid guide 650 may have at least one nozzle disposed therein, and as shown by FIG. 6A, there may be at least a first fluid nozzle 656*a* and a second fluid nozzle 656*b*.

There may be one or more fluid guide blades 652 disposed on the fluid guide 650, as well as a flow are 664 defined by a space between the fluid guide blades 652. In some embodiments, the fluid guide 650 may be configured to induce distribution of fluid flow in an area, such as, for example, an annulus 606 and/or flow regime 671 above the drill bit 609. To promote desired flow patterns, the drill bit 609 may be adapted with an electronic control system, which may include a power source 690 in connection with a solenoid 691. The power source 690 may be, for example, a battery pack disposed in the drill bit 609. Alternatively, the power source 690 may be part of surface equipment that is in connection with drillstring 602 and drill bit 609 via cables, wires, etc., as would be known to one of skill in the art.

The power source 690 may be configured to actuate the first solenoid 691, whereby actuation of the first solenoid 691 causes a plug 692 to move back and forth in proximity to fluid inlets 679. The fluid inlets 679 may be disposed within a plenum 626, such that as drilling fluid 611 flows into the plenum 626 the fluid will be distributed into the inlets 679 when the plug 692 moves backward to expose the inlets 679 to fluid passageway or bore 653. As a result, the drilling fluid 611 may then flow from the plenum 626, into the inlets 679, through the bores 653, and out of the nozzles 656*a* or 656*b*.

Although FIG. 6B illustrates fluid flow through nozzle 656*b*, the fluid guide 650 and electric control system may be configured to control flow out nozzles 656*a* and 656*b*, respectively. In an embodiment, the control system may be used to oscillate flow out of the nozzles 656*a* and 656*b*, as represented in FIG. 6C, whereby a "pulse" flow is created from the fluid guide 650. For example, the power source 690 may actuate the first solenoid 691, such that fluid first flows out of the nozzle 656*a*. Then, the power source 690 may be used to actuate another solenoid (not shown) that controls the movement of another plug (not shown) related to the nozzle 656*b*. However, the electric control of the drill bit is not meant to be limited, and other nozzles 656 and 622 may be operatively connected thereto, such that the control system may control or oscillate fluid flow out of any number of nozzles 656 and 622, as may be desired to optimize flow patterns in, around, and above the drill bit 609.

Figure 7B:
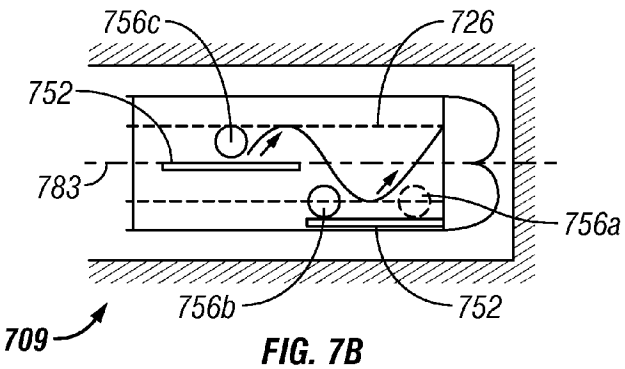
FIGS. 7A and 7B show cross-sectional views of a fluid guide 750 having a staggered configuration, in accordance with embodiments of the present disclosure.
Figure 7A:
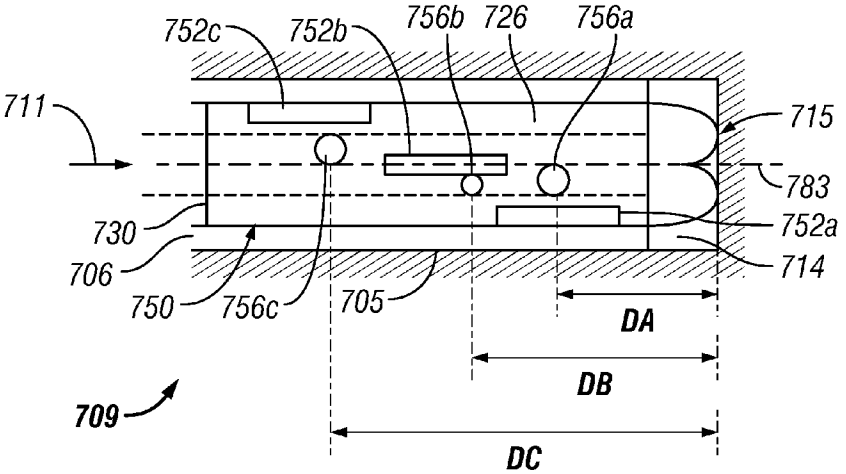
Figure 7C:
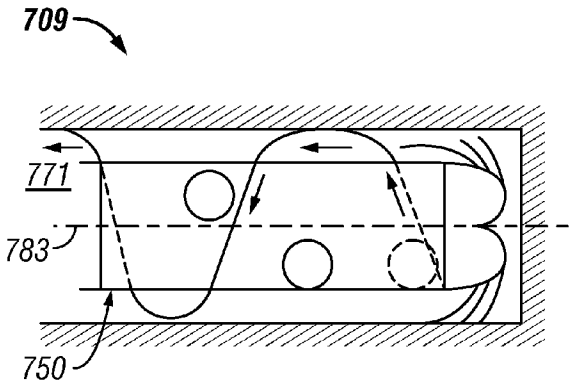
FIG. 7C shows a side view of the fluid guide of FIGS. 7A and 7B, in accordance with embodiments of the present disclosure.

Referring now to FIGS. 7A-7C, various cross-sectional views of a fluid guide 750 having a staggered configuration in accordance with embodiments disclosed herein, are shown. The previously mentioned fluid guides may have any number of optimized configurations to obtain the greatest amount of efficiency from drill bits used in drilling operations. FIGS. 7A and 7B together show fluid guide 750 may be configured with longitudinally staggered nozzles 756, such that, for example, nozzles 756*a*, 756*b*, and 756*c* are disposed at different distances Da, Db, and Dc, respectively, from a bit face 715.

In addition, the nozzles 756*a*, 756*b*, and 756*c* may be laterally staggered from each other. Meaning, from a cross-sectional standpoint, nozzle 756*a* may be disposed at a lateral distance La from long axis 783, nozzle 756*b* may be disposed at a lateral distance Lb, and nozzle 756*c* may be disposed at distance Lc from the axis 783. However, the distances from the axis 783 may be equidistant, such that one of more of the nozzles 756 may longitudinally align with another nozzle, as illustrated by FIG. 7B Likewise, the blades 752 may have staggered positions comparable to the nozzle positions described above. As such, some blades 752 may align equistantly, and/or some blades 752 may be offset from other blades 752, with reference to both the bit face 715 and the long axis 783. A fluid guide 750 that has a staggered configuration of blades 752 and/or nozzles 756 may provide a vortextually induced (e.g., spiral) fluid flow around the drill bit 709, including through flow areas (364, FIG. 3A) around the fluid guide 750. The vortex-induced flow may provide improved hydraulic efficiency by allowing drilling fluid and/or cuttings to be evenly distributed from the drill bit to flow areas above the drill bit, such as annulus 706, flow region 771, etc.

In order to avoid pressure drop in or near the drill bit 709 that could contribute to bit balling, the orifices of the nozzles 756 may be sized accordingly. For example, because pressure of drilling fluid 711 entering the drill bit 709 might be higher at nozzle 756*c*, the size of orifice may be larger so that the pressure of fluid exiting nozzle 756*c* is lower than the pressure of the fluid exiting nozzle 756*a*. Conversely, the pressure of the drilling fluid 711 at nozzle 756*a* might be lower as compared to the pressure at other nozzles, such that the size of orifice in nozzle 756 may be smaller so that the pressure of fluid exiting nozzle 756*a* is higher than the pressure of the fluid exiting other nozzles. As a result of the pressure profile in the drill bit 709, there may also be a spiral flow established within the plenum 726. Such a pressure profile may result in reduced internal erosion of the plenum 726. Although not shown here, the same methodology and description applies for the nozzles (and orifices) disposed in the bit face 715.

Figure 4:
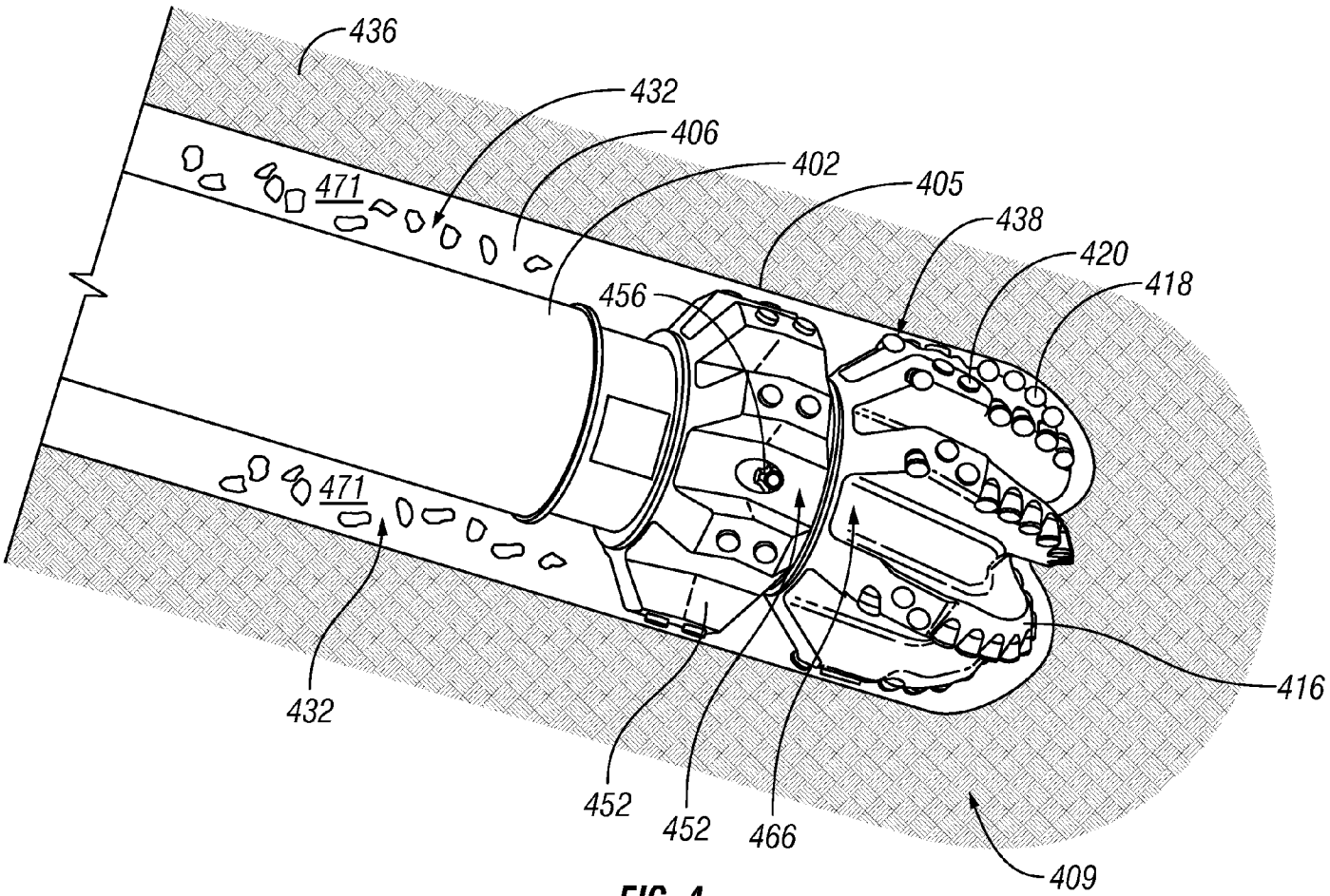
FIG. 4 shows a side view of a highly efficient drill bit 409 usable in a drilling system 401, in accordance with embodiments of the present disclosure.

Referring now to FIG. 4, a highly efficient drill bit 409 usable in a drilling system 401 according to embodiments of the present disclosure, is shown. The drilling system 401 may include the provision of drilling fluid into the drill bit 409 via surface equipment, such as pumps, as previously described. The size (e.g., diameter) of the drillstring 402 with respect to the wellbore 405 may define an annulus 406, which may be sufficient in size to allow for return of drilling fluid and entrained cuttings (e.g., formation cuttings, other debris, etc.) to the surface.

The drilling fluid may be transported down to the drill bit 409 through a bit inlet, and into a fluid cavity or plenum (226, FIG. 2C). From the plenum, the drilling fluid may flow from the cavity through one or more internal channels or bores (223, FIG. 2C), and out of the drill bit 409 via one or more nozzles 456 and/or 422 (with corresponding orifices) in connection therewith. The pressure of the drilling fluid as delivered to the bit face 415 through the nozzles 422 and 456 may be sufficient to overcome the hydrostatic head at the drill bit 409, and the flow velocity may be sufficient to carry the drilling fluid (along with entrained cuttings) away from the bit face 415, past flow areas 464, into the annulus 406, and to the surface.

Because the nozzles 456 are not located on the bit face 415, the fluid exiting therefrom has no direct effect on the drilling function of the drill bit 409. Instead, the fluid guide 450 may provide extra hydraulic energy into flow areas above the bit body 414. The bit body 414 may include "junk slots" 466 to aid flow patterns around the bit body 414. The junk slot 466 may be adjacent to and/or between corresponding bit blades 418, such that the junk slots 466 may allow the drilling fluid to flow from the nozzles 422 disposed in the bit face 415 to the sides of the drill bit 409. In certain embodiments, the fluid flow from the nozzles 456 may be directed upward from the bit body 414, such that the momentum of that fluid flow induces upward flow of drilling fluid and cuttings away from the bit face 415 and bit body 414 via junk slots 466.

As shown, there may be a fluid guide 450 operatively attached to the drill bit 409, which may be configured to improve the hydraulic efficiency of the drill bit 409. In an embodiment, the fluid guide 450 may provide improved distribution of fluid flow above the drill bit 409. As a result, flow regimes 471 above the drill bit may have evenly distributed cuttings 432 disseminated therein. With improved distribution of fluid flow above the drill bit 409, additional drilling fluid and cuttings are more readily removed upward and away from the bit face 415, thereby increasing the hydraulic efficiency of the drill bit, as well as preventing bit balling.

Embodiments disclosed herein may provide for a method of hydraulically removing debris from a wellbore, the method including drilling a wellbore, dispersing fluid into the wellbore to fluidly move debris, wherein the fluid is dispersed at a bottom of the wellbore, and inducing upward and even distribution of the fluid dispersed in the bottom of the wellbore, wherein the evenly distributed fluid enhances the removal of debris from the wellbore. In a specific embodiment, the method may include directionally drilling the wellbore, whereby a first part of the wellbore is further away from a surface of the Earth as compared to a second part of the wellbore located radially opposite the first part.

Embodiments disclosed herein may advantageously provide for apparatuses and methods used to improve the efficiency of hydraulic cleaning of areas around a drill bit. The disclosure is useful for any type of drill bit used in the drilling of subterranean formations, which may beneficially include the ability to couple a fluid guide to existing drill bits.

The fluid guide of the present disclosure advantageously overcomes limitations of the prior art by providing new and improved design features that enhance the efficiency of drill bits used in drilling operations. As a result, drill bits have reduced or eliminated bit balling, and formation cuttings may be easily removed without the need to stop drilling operations to clear the bit face. The ability to evenly distribute fluids into areas above the drill bit with increased energy reduces stagnant flow areas and improves overall hydraulic efficiency. By incorporating new features at areas other than the bit face or plenum area, embodiments of the present disclosure may advantageously be optimized to provide the greater amounts of drill bit efficiency than drill bits of the prior art.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A drill bit comprising:

a bit body having a fluid passageway therein;

a fluid guide operatively connected to the bit body and comprising at least one nozzle, wherein said at least one nozzle comprises at least one inlet operatively associated with the fluid passageway, wherein the fluid guide comprises at least one nozzle disposed therein, wherein the at least one nozzle is both flanked by fluid guide blades and located within a junk slot on an outer surface of the fluid guide;

a plug movable between a first position in which the plug obstructs said at least one inlet and prevents fluid communication between the fluid passageway and said at least one nozzle and a second position in which said at least one nozzle is in fluid communication with the fluid passageway via said at least one inlet; and an actuator associated with the plug and adapted to move the plug between the first position and the second position.

2. The drill bit of claim 1, wherein the actuator comprises a solenoid in communication with a power source.

3. The drill bit of claim 2, wherein said at least one nozzle comprises a plurality of nozzles, and wherein a control system operatively associated with the actuator is configured to oscillate fluid flow through the plurality of nozzles to create a pulsed flow above the bit body.

4. The drill bit of claim 1, further comprising:

the bit body having an axis, and wherein an orifice of the at least one nozzle is oriented at an angle from the axis in the range of about 15 to 75 degrees.

5. The drill bit of claim 1, wherein the fluid guide comprises a first outer diameter, wherein the bit body comprises a second outer diameter, and wherein the first outer diameter is less than the second outer diameter.

6. The drill bit of claim 1, wherein the fluid guide comprises a plurality of the fluid guide blades disposed along the outer surface of the fluid guide, and wherein the bit body comprises a plurality of primary blades disposed along an outer surface of the bit body.

7. The drill bit of claim 6, wherein the plurality of the fluid guide blades is discontinuous from the plurality of primary blades.

8. The drill bit of claim 6, wherein the plurality of the fluid guide blades is disposed equidistantly apart from each other, and wherein the plurality of primary blades is disposed equidistantly apart from each other.

9. The drill bit of claim 1, wherein the fluid guide is rotatably independent of rotation of at least one of a drill string to which the drill bit is coupled, the drill bit, the bit body, and combinations thereof.

10. The drill bit of claim 1, wherein the fluid guide is configured to induce substantially even distribution of fluid flow within a portion of a wellbore annulus proximate to the drill bit.

11. The drill bit of claim 1, wherein the fluid guide is integrally connected to the bit body.

12. The drill bit of claim 1, wherein the bit body and the fluid guide comprise a substantially unrestricted flowpath extending therethrough for flowing fluid from a drillstring through the fluid guide and the bit body.

13. The drill bit of claim 1, wherein the actuator is configured to convey power or force to the fluid guide to cause independent rotation thereof relative to said at least one of a drill string to which the drill bit is coupled, the drill bit, the bit body, and combinations thereof.

* * * * *